US009435618B2

(12) United States Patent
Dean

(10) Patent No.: US 9,435,618 B2
(45) Date of Patent: Sep. 6, 2016

(54) FIREWORKS SAFETY IGNITER

(71) Applicant: Billy R Dean, Havre, MT (US)

(72) Inventor: Billy R Dean, Havre, MT (US)

( * ) Notice: Subject to any disclaimer, the term of this patent is extended or adjusted under 35 U.S.C. 154(b) by 0 days.

(21) Appl. No.: 14/712,324

(22) Filed: May 14, 2015

(65) Prior Publication Data

US 2015/0330758 A1 Nov. 19, 2015

Related U.S. Application Data

(60) Provisional application No. 61/992,955, filed on May 14, 2014.

(51) Int. Cl.
*F42B 4/00* (2006.01)
*F23Q 7/16* (2006.01)
*F42C 19/12* (2006.01)

(52) U.S. Cl.
CPC . *F42B 4/00* (2013.01); *F23Q 7/16* (2013.01); *F42C 19/12* (2013.01)

(58) Field of Classification Search
CPC ..... F42C 19/12; F42B 4/00; F23Q 7/14; F23Q 7/16
USPC ..... 102/206, 361, 200, 202.14
See application file for complete search history.

(56) References Cited

U.S. PATENT DOCUMENTS 2,003,483 A 6/1935 Frye
2,114,176 A 4/1938 Christ
3,570,403 A 3/1971 Hawley et al.
4,825,764 A * 5/1989 Jullien ..... F42D 1/043 102/202.14
6,874,424 B2 4/2005 Bailey et al.
7,688,566 B2 3/2010 Zhang
8,365,665 B2 2/2013 Risner et al.
2006/0060575 A1 3/2006 Lindsey et al.
2013/0327240 A1 * 12/2013 Guerra ..... F42B 3/124 102/202.7

FOREIGN PATENT DOCUMENTS

CN 2166130 5/1994
CN 20216216 1/2012
CN 203100571 7/2013

* cited by examiner

*Primary Examiner* — Reginald Tillman, Jr.
(74) *Attorney, Agent, or Firm* — James Ray and Assocs

(57) ABSTRACT

A firework safety igniting device includes a housing having a hollow interior and an open end, the open end sized to receive a firework fuse therethrough; A first electrode is mounted within the hollow interior on an interior surface of the housing. A second electrode is also mounted within the hollow interior on the interior surface in a spaced apart relationship with the first electrode. A source is provided to generate and supply, through wires, an electric charge to the first and second electrodes, whereby the first electrode is being negatively charged and the second electrode is being positively charged. The firework fuse, being inserted into the hollow interior through the open end, is positioned in a contact with the first and second electrodes, the contact transferring the electric charge to the firework fuse causing an ignition thereof.

19 Claims, 4 Drawing Sheets

FIREWORKS SAFETY IGNITER

CROSS-REFERENCE TO RELATED APPLICATIONS

This application is related to and claims priority from U.S. Provisional Patent Application Ser. No. 61/992,955 filed on May 14, 2014.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

1. Technical Field

The subject matter relates to igniters. It further relates to an electrically operable fireworks igniter that is safe to use.

2. Description of Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

As is generally known, firecrackers and other fireworks commonly include a fuse and a casing which houses the charge. The firework may be set on, the ground and the fuse is lit with a lighter, matches or a punk. Each of these methods of lighting the fuse may be inherently dangerous. Sparks emitted from the fuse may burn the user. Lighters and matches present an open flame which may ignite other combustibles or burn the user, and the lighter and matches remain hot immediately after use. A punk, although safer than a lighter and matches, is always burning and may burn the user or inadvertently ignite other fireworks.

To the best knowledge of the Inventor, existing firework igniting devices are either ineffective in use or costly to manufacture.

Therefore, there is a need for an improved device for safely lighting the fuse of the firework.

BRIEF DESCRIPTION OF THE DRAWINGS

The accompanying drawings are incorporated in and constitute part of the specification and illustrate various embodiments. In the drawings.

DETAILED DESCRIPTION OF EXEMPLARY EMBODIMENTS

Figure 1:
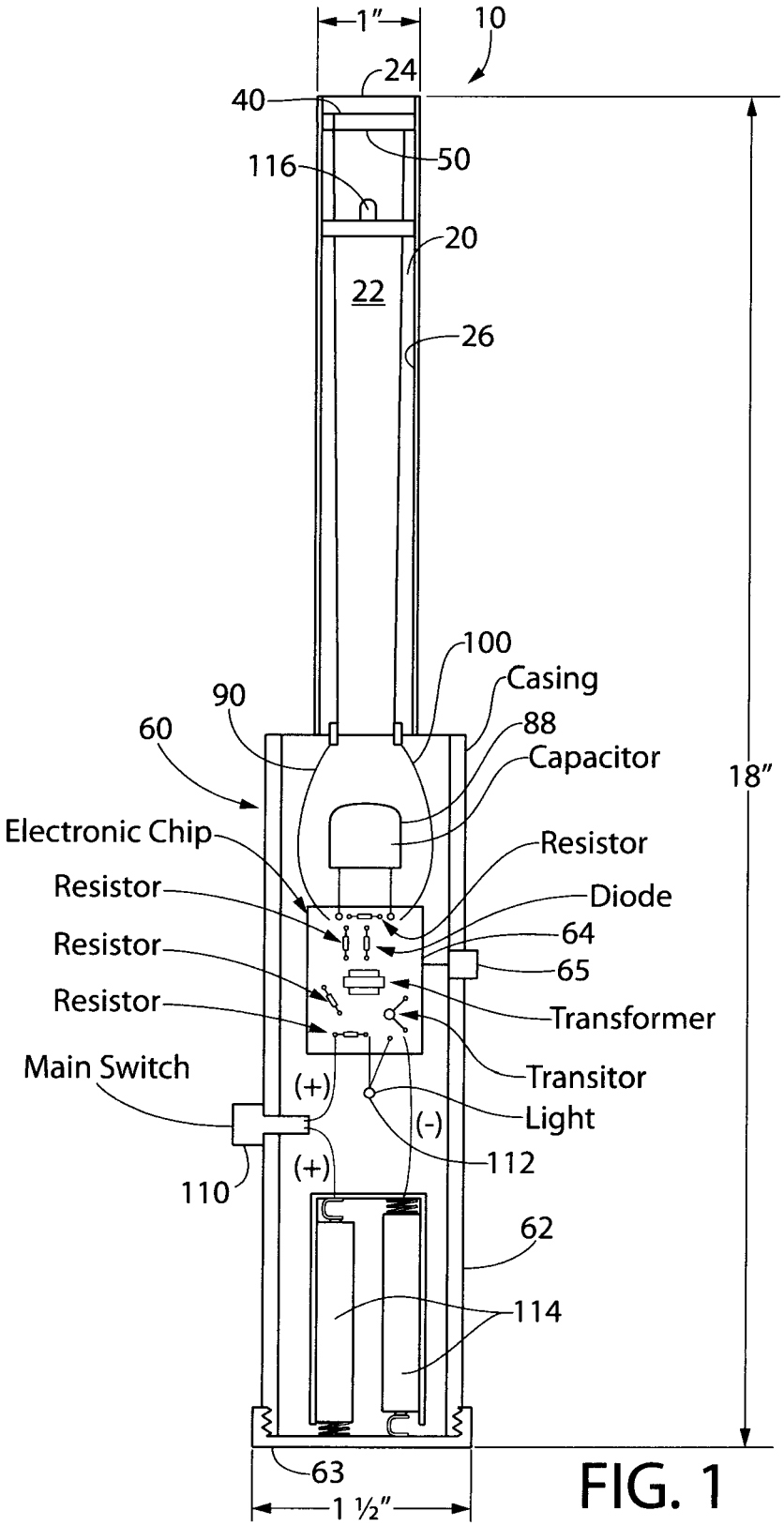
FIG. 1 illustrates a longitudinal diagrammatic view of an exemplary igniting device for safely igniting a firework fuse.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. As used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," "exterior," "interior," and derivatives thereof shall relate to the invention as oriented in the Figures. Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a surface" includes reference to one or more of such surfaces.

The particular embodiments of the present disclosure generally provide a device, or an article of manufacture, directed to ignition of firework fuses, preferably in a safe manner.

In particular embodiments, the device for safely igniting firework fuses is battery operated.

In particular embodiments, device for safely igniting a firework is configured for a remote operation.

In particular embodiments, device for safely igniting a firework is configured for a hand-held operation.

Now in reference to FIGS. 1-4, and in accordance with one exemplary embodiment, therein is provided a firework safety igniting device 10 operable to ignite a firework fuse 2. The device comprises a housing 20 having a hollow interior 22, an open end 24, and an interior wall surface 26. The open end 24 is sized to receive the firework fuse 2 therethrough. In one example, the cross-sectional shape of the housing 20 in a direction normal to a length thereof is an annular wall to operatively receive firework fuse 2 of a conventionally round cross-sectional shape. However, other cross-sectional shapes are contemplated to accommodate different cross-sectional shapes of the firework fuse 2. For the reasons to be explained below, the housing 20 is manufactured, either completely or partially, from an electrically conductive material.

Figure 2:
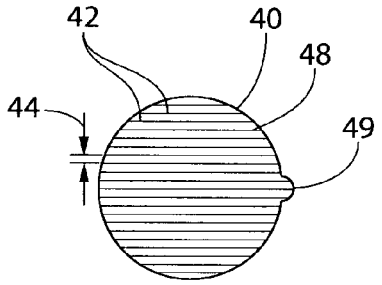
FIG. 2 is planar view of one electrode employed within the exemplary igniting device of FIG. 1.

A first electrode 40, shown in more details in FIG. 2, is mounted within the hollow interior 22 normal to a longitudinal axis 12 of the device 10 and at a distance from the open end 24 of the housing 20. The first electrode 40 includes wires 42 disposed parallel to each other and being oriented in a first direction. Adjacent wires 42 are spaced from each other at a first distance 44. The wires 42 may be terminated by an annular member 48, when the firework fuse 2 is provided with a round cross-section, for example for ease of subsequent assembly into the device 10. A ground projection 49 is disposed on the annular member 48. During assembly, the ground projection 49 is mounted to abut the interior wall surface 26 so as to ground the first electrode 40 to the housing 20. The housing 20 does not have to be manufactured completely from a metal so as to enable grounding and may, for example, be manufactured from an electrically non-conductive material and include a metallic insert (not shown) providing electric grounding.

Figure 3:
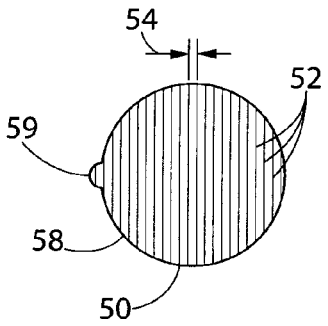
FIG. 3 is planar view of another electrode employed within the exemplary igniting device of FIG. 1.

A second electrode 50, shown in more details in FIG. 3, is also mounted within the hollow interior 22 normal to the longitudinal axis of the housing 20 and at a distance from the first electrode 40. The second electrode 50 includes wires 52 disposed parallel to each other and being oriented in a second direction. Adjacent wires 52 are spaced from each other at a second distance 54. The wires 52 may be terminated by an annular member 58. A ground projection 59 is disposed on the annular member 58. During assembly, the ground projection 59 is mounted to abut the interior wall surface 26 so as to ground the second electrode 50 to the housing 20. The second distance 54 is smaller than the first distance 44. The second direction of wires 52 is shown in FIG. 3 as being perpendicular to the first direction of wires 42 but may be oriented at other angles.

Wires 42 and 52 are manufactured from electrically conductive material, for example such as copper, steel or the like. Parallel arrangement of wires 42 and/or 52 may be replaced with a grid-like pattern. Furthermore, the inner electrode, being shown as the second electrode 50 may be provided in a solid form, rather than wire form.

Figure 8:
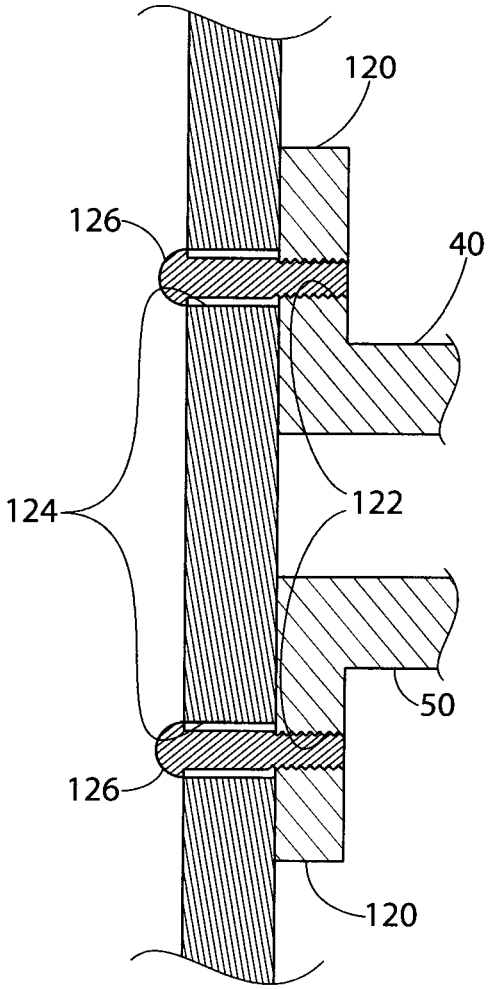
FIG. 8 illustrates an exemplary attachment of the electrodes employed within the firework fuse igniting device of FIG. 1.

Both the first electrode 40 and the second electrode 50 are secured within the hollow interior 22 in a manner that prevents longitudinal movement thereof. In one example, the housing 20 may be manufactured from two halves with the first electrode 40 and the second electrode 50 being permanently secured, for example by welding, to an inner wall surface of one half. In another example, the first electrode 40 and the second electrode 50 may be secured at their respective ground projections 49 and 59. In another example, the first electrode 40 and the second electrode 50 may be slightly compressed during the assembly so as to be held by friction sufficient to prevent movement thereof during repetitive insertion of the firework fuse 2. In yet another example of FIG. 8, each of the first and second electrodes, 40 and 50 respectively, may be provided with a flange 120 having a threaded aperture 122 formed through a thickness thereof and aligned with an aperture 124 through the wall of the housing 20 so as to operatively mate with a fastener 126. In any of the above examples, the first and second electrodes, 40 and 50 respectively, may be assembled with an aid of a positioning tool or a fixture (not shown) configured to temporarily hold each electrode during installation.

In order to ignite the firework fuse 2, an electric charge is applied to the first and second electrodes, 40 and 50 respectively.

Figure 4:
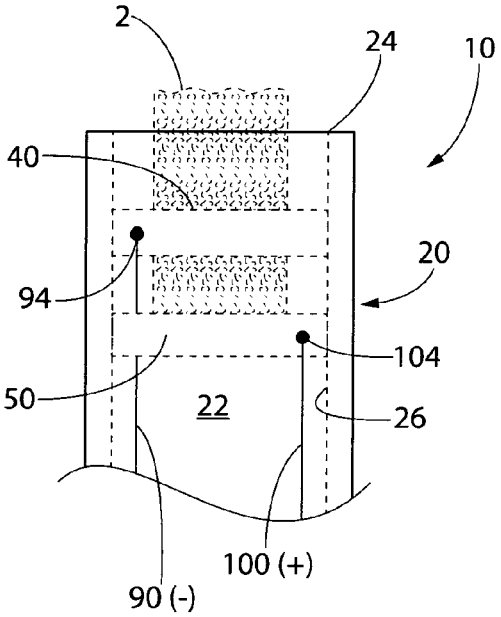
FIG. 4 is a partial enlarged view of the firework fuse igniting device of FIG. 1.

In operation, an end of the firework fuse 2, being manually inserted into the hollow interior 22 through the open end 24, is manually forced to pass through the wires 42 in the first electrode 40, in a contact therewith, for a subsequent contact with the wires 52 of the second electrode 50, as is best shown in FIG. 4. The pattern of first wires 42 is configured to cut into a generally soft material of the firework fuse 2. The contact of the firework fuse 2 with wires in the first and second electrodes, 40 and 50 respectively, transfers the electric charge from the activated circuit 60 to the firework fuse 2 causing an ignition thereof. The inset of the first electrode 40 from the open end 24 allows for a temporary retention of the firework fuse 2 in a hands-free manner. In other words, the housing 20 is configured to temporarily hold or retain the firework fuse 2 without further manual help from the user of the device 10. The length of the device 10 is so selected that, during such operation, the user does not have to be in a close proximity to the firework fuse 2, thus obviating most if not all safety issues and/or concerns.

Figure 6:
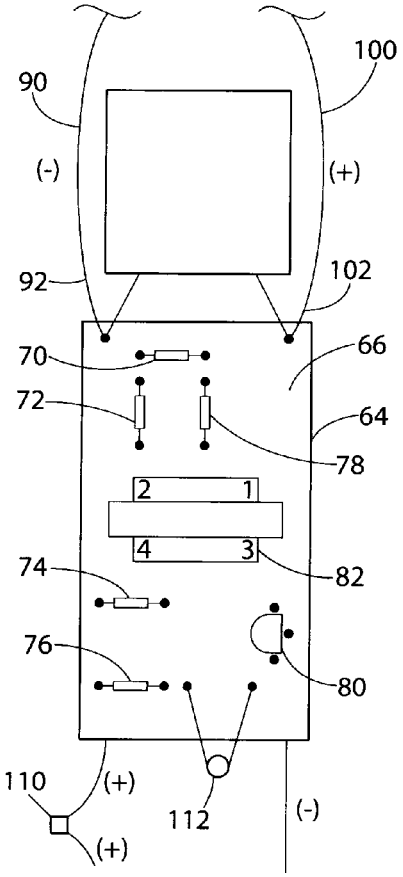
FIG. 6 is a top diagrammatic view of an exemplary control circuit employed within or with the firework fuse igniting device of FIG. 1 or 5.
Figure 7:
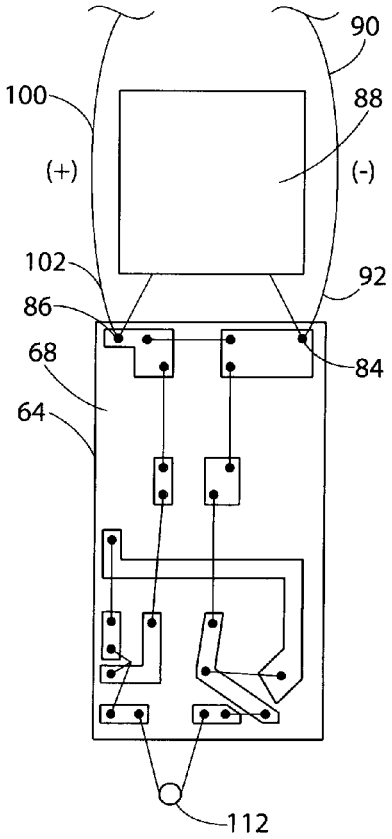
FIG. 7 is a bottom diagrammatic view of the control circuit of FIG. 6.

In a further reference to FIG. 1 and in a reference to FIGS. 6-7, therein is illustrated a source of the electric charge in accordance with one exemplary embodiment, which is a circuit or circuit assembly 60 that is configured and operable to generate the electric charge and supply it to the first and second electrodes, 40 and 50 respectively.

The circuit 60 may include a board 64 having a first surface 66 and an opposite surface 68. Disposed on one surface, such as the first surface 64, are resistors 72, 74, and 76, diode 78, transistor 80 and transformer 82, converting AC voltage into DC voltage. The second surface 66 contains circuit of traces and/or physical electrical connection between the above referenced components. The circuit 60 also includes two connections 84 and 86 to which capacitor 88 is connected. The capacitor 88 provides a DC charge to the electrodes 40 and 50 sufficient to ignite the firework fuse 2. Such charge may be, for example, of about 400 VDC.

Also, the device 10 includes a first wire 90 that has a first end 92 thereof connected the connection 84. The second end 94 of the wire 90 is connected to the first electrode 40. The device 10 also includes a second wire 100 that has a first end 102 thereof connected the connection 86. The second end 104 of the second wire 100 is connected to the second electrode 50. The connection may be so configured that the first electrode 40 is negatively charged and the second electrode 50 is positively charged, although the polarity of the electrodes can be reversed In operation, the first and second wires, 90 and 100 respectively supply the electric charge generated by the circuit 60 and, more particularly by the capacitor 88.

In a further reference to FIGS. 6-7, the exemplary circuit 60 is disposed within another hollow housing 62. The housing 62 may be made integral with the housing 60 or may be securely attached thereto by any conventional techniques, including but not limited to welding, bonding, mechanical crimping and the like. It would be understood that in these forms the hollow housing 62 becomes an extension of the housing 20 and may further function as a handle, thus configuring the device 10 for a hand-held use during ignition of the firework fuse 2.

Still in a further reference to FIGS. 6-7, the device 10 may include a power switch 110 coupled to the circuit board 62 that is manually operable by the user to trigger the circuit 60 in order to generate the electric charge. The device 10 may also include an optional light indicator 112, for example such as an LED device, coupled to the circuit 60 so as to visually annunciate operability of the circuit 60. The light indicator 112 made be connected to the circuit 60 either to be lit continuously while there is a supply of electric energy to the circuit 60 or be lit only when the power switch 110 is operated to connect supply of electric energy to the circuit 60, thus activating the circuit 60.

The device 10 and, more particularly the circuit 60, is coupled to a supply source of electric energy so as to apply electric charge to the first and second electrodes, 40 and 50 respectively In one example, in further reference to FIG. 1, when the device 10 includes the circuit 60, the device 10 may also include one or more batteries 114 that may be disposed within the hollow interior of the housing 62. When provided, the one or more batteries 114 are coupled to the switch 110 and to the circuit 60. Thus, essentially, the switch 110 is manually operable to selectively supply the electric energy to the circuit 60 and, more particularly, to the electrodes 40 and 50. Although the one or more batteries 114 are illustrated in FIG. 1 as an elongated batteries, for example such as AA or AAA batteries, they also may be of a round, pancake-like shape.

The housing 62 may be adapted to receive an end cap 63 in any of the conventional manners, not being critical to the instant invention, so as to allow selective access to the one or more batteries 114.

It is further contemplated herewithin that the end cap 63 can be replaced with a conventional cover (not shown) mounted along at least a portion of a length of the housing 62 and even that the housing 62 can be manufactured in two halves that are releaseably or permanently joined together by any conventional means.

In another example, the source of the electric charge may be disposed remotely from the circuit 60, wherein the circuit 60 can be adapted for a direct or an indirect connection to a remotely positioned power source, for example such as a conventional outlet. In this example, when the circuit 60 is disposed within the housing 62, the device 10 may be adapted with a connector 65 accessible from the exterior surface of the housing 62 and being electrically coupled to the circuit 60.

Figure 5:
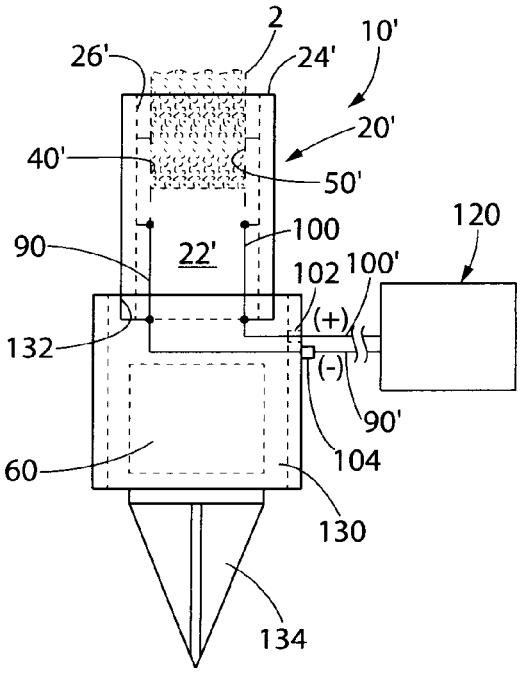
FIG. 5 is a partial enlarged view of another exemplary firework fuse igniting device.

Now in reference to FIG. 5, therein is illustrated another exemplary embodiment of a firework safety igniting device, generally designated as 10', wherein a first electrode 40', for example such as a strip of an electrically conductive material, is mounted within the hollow interior 22' on an interior surface 26' of the housing 20' and a second electrode 50' for example such as the strip of an electrically conductive material, is also mounted within the hollow interior 22' on the interior surface 26' opposite or adjacent the first electrode 40'. In either form, the electrodes 40' and 50' are so positioned and are spaced apart with each other so that the firework fuse 2, being inserted into the open end 24', contacts both electrodes 40' and 50', whereby the contact of the firework fuse 2 with the first and second electrodes, 40 and 50 respectively, transfers the electric charge to the firework fuse 2, causing an ignition thereof. The electrodes 40', 50' may be secured, in an electrically conducting manner, to the interior surface 26' of the housing 20' with adhesive, fasteners, or by a welding method In another exemplary embodiment, the circuit 60 may be disposed remotely from the housing 20, 20'. The circuit 60 may be then contained within a remote ignition device 120. When the device 10, 10' is configured for a remote ignition, the wires 90' and 100' are then extended past an exterior surface of the housing 20, 20' and are adapted to connect the first and second electrodes, 40' and 50' respectively, to the remote ignition device 120. In this exemplary embodiment, the wires 90' and 100' may be passed through apertures 102 in the housing wall becoming wires 90 and 100 or the housing 20, 20' may have additional electrical connection(s) 104, for example such as an electrical connector, accessible from the exterior surface of the housing wall for a releaseable coupling of the wires 90' and 100' to respective wires 90 and 100.

Furthermore, in yet another exemplary embodiment of FIG. 5, therein is provided a holder 130 having a cavity 132 sized to receive the exterior peripheral surface of the housing 20, 20' and having an end 134 configured to support the device 10 or 10' in a vertical direction above a ground surface. By way of one example only, the end 134 is illustrated as a conventional ground stake to mount the device 10 or 10' above ground. Such holder 130 may be used adjacent a firework mount when the firework fuse 2 is of a sufficient length to reach the holder 130. Such holder 130, particularly without the stake-shaped end 134 is sufficiently light to be suspended on the firework fuse 2.

The circuit 60, with or without one or more batteries 114, may be disposed remotely from the holder 130, as is shown in FIG. 5, or may be disposed within the interior of the holder 130.

In some of the various exemplary embodiments, the device 10, 10' may include an optional light indicator 116, such as an LED device, that may be mounted, internal, as is shown in FIG. 1, or external to the housing 20, in a connection with the circuit 60, for example through the above described wires 90 and 100, and in a position to illuminate the firework fuse 2.

The method of safely igniting firework fuse 2 comprises the steps of providing a pair of electrodes; the step of positioning the electrodes, within a housing, in a spaced apart relationship with each other, the step of positioning the firework fuse 2 in a contact with both electrodes and the step of supplying, with a source, electric charge to the firework fuse 2 being in such contact with both electrodes. The steps of providing a pair of electrodes may include the step of configuring one electrode to allow passage of the firework fuse 2 therethrough. The step of supplying a charge of electric energy may include the step of providing the source as a circuit and the step of positioning the circuit within the housing or the step of positioning the circuit remotely from the housing. The above described method functions or operates as a method to position the user at a distance from the firework fuse 2 sufficient to obviate most if not all safety issues and/or concerns when igniting firework fuse 2. The above described method functions or operates as a method for igniting the firework fuse 2 with a hand-held device.

The chosen exemplary embodiments of the claimed invention have been described and illustrated for practical purposes so as to enable any person skilled in the art to which it pertains to make and use the same. It is therefore intended that all matters in the foregoing description and shown in the accompanying drawings be interpreted as illustrative and not in a limiting sense. It will be understood that variations, modifications, equivalents and substitutions for components of the specifically described exemplary embodiments of the invention may be made by those skilled in the art without departing from the spirit and scope of the invention as set forth in the appended claims. For example, the circuit 60 may be replaced with a solid-state device, for example such as an integrated circuit or a chip, configured and operable to supply the electric charge to the electrodes.

As used herein, the terms "adapted" and/or "configured" mean that the element, component, or other subject matter is designed and/or intended to perform a given function. Thus, the use of the terms "adapted" and/or "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

Any element in a claim that does not explicitly state "means for" Performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Furthermore, the Abstract is not intended to be limiting as to the scope of the claimed invention and is for the purpose of quickly determining the nature of the claimed invention.

What is claim is:

1. A firework safety igniting device comprising:

a housing having a hollow interior and an open end, said open end sized to receive a firework fuse therethrough;

a first electrode mounted within said hollow interior of said housing in a contact with an interior surface thereof, said first electrode being coupled to a source of an electric charge; and a second electrode mounted within said hollow interior in a contact with said interior surface thereof, said second electrode being coupled to the source of electric charge, said second electrode being disposed in a spaced apart relationship with said first electrode such that the firework fuse, being inserted into said hollow interior through said open end, contacts said first and second electrodes, whereby said contact of the firework fuse with said first and second electrodes transfers said electric charge to the firework fuse causing an ignition thereof.

2. The firework safety igniting device of claim 1, wherein each of said first and second electrodes includes wires disposed parallel to each other.

3. The firework safety igniting device of claim 2, wherein wires in said second electrode are oriented in a different direction than wires in said first electrode.

4. The firework safety igniting device of claim 2, wherein a spacing between adjacent wires in said first electrode is greater than a spacing between adjacent wires in said second electrode.

5. The firework safety igniting device of claim 1, wherein said first electrode is being negatively charged during operation of said device, wherein said second electrode is being positively charged during operation of said device and wherein said first electrode is mounted closer to said open end.

6. The firework safety igniting device of claim 1, wherein each of said first and second electrodes is mounted on said interior surface of said housing.

7. The firework safety igniting device of claim 1, further comprising said source of said electric charge.

8. The firework safety igniting device of claim 7, wherein said source of said electric charge includes:

a circuit board with an electrical connection circuit disposed on a surface thereof and having connection(s) to a source of electric energy;

a transformer mounted on said circuit board and;

at least one of a diode, resistor and transistor mounted on said circuit board coupled to said electrical connection circuit;

a capacitor coupled to said electrical connection circuit;

a first wire coupled at one end thereof to said electrical connection circuit and coupled at an opposite end thereof to one of said first and second electrodes; and a second wire coupled at one end thereof to said electrical connection circuit and coupled at an opposite end thereof to another one of said first and second electrodes.

9. The firework safety igniting device of claim 8, further comprising a light indicator coupled to said circuit board.

10. The firework safety igniting device of claim 8, further comprising a switch coupled between said source of said electric charge and the source of electric energy and operable to selectively activate and deactivate said source of said electric charge.

11. The firework safety igniting device of claim 8, further comprising one or more batteries electrically coupled to said source of said electric charge.

12. The firework safety igniting device of claim 7, further including another housing connected to said housing and wherein said source of said electric charge is mounted within said another housing.

13. The firework safety igniting device of claim 7, wherein said source of said electric charge is mounted remotely from said housing.

14. The firework safety igniting device of claim 1, further comprising a light emitting source mounted within said hollow interior.

15. The firework safety igniting device of claim 1, further comprising a mounting member configured to position said housing above a ground surface.

16. A firework safety igniting device comprising:

a housing having a hollow interior and an open end, said open end sized to receive a firework fuse therethrough, said housing is at least partially manufactured from an electrically conductive material;

a first electrode mounted, in an electrically grounded manner with said housing, within said hollow interior normal to a longitudinal axis of said device and at a distance from said open end thereof, said first electrode including wires disposed parallel to each other, being spaced from each other at a first distance and being oriented in a first direction;

a second electrode mounted, in said electrically grounded manner with said housing, within said hollow interior normal to said longitudinal axis of said housing and at a distance from said first electrode, said second electrode including wires disposed parallel to each other, being spaced from each other at a second distance and being oriented in a second direction, wherein said second distance is smaller than said first distance, and wherein said second direction is perpendicular to said first direction;

a source generating and supplying, through wires, an electric charge to said first and second electrodes, whereby said first electrode is being negatively charged and said second electrode is being positively charged;

whereby the firework fuse, being inserted into said hollow interior through said open end, passes said wires in said first electrode, in a contact therewith, for a further contact with said wires of said second electrode; and whereby said contacts of the firework fuse with wires in said first and second electrodes transfers said electric charge to the firework fuse causing an ignition thereof.

17. The firework safety igniting device of claim 16, wherein said source is disposed within said housing.

18. The firework safety igniting device of claim 16, wherein said source is disposed external to said housing and wherein said wires extend past an exterior surface of said housing.

19. A firework safety igniting device comprising:

a housing having a hollow interior and an open end, said open end sized to receive a firework fuse therethrough;

a first electrode mounted within said hollow interior on an interior surface of said housing;

a second electrode mounted within said hollow interior on said interior surface in a spaced apart relationship with said first electrode;

a source generating and supplying, through wires, an electric charge to said first and second electrodes, whereby said first electrode is being negatively charged and said second electrode is being positively charged; and wherein the firework fuse, being inserted into said hollow interior through said open end, is positioned in a contact with said first and second electrodes, said contact transferring said electric charge, generated and supplied by said source, to the firework fuse causing an ignition thereof.

* * * * *